US007147547B2

(12) United States Patent
Junker

(10) Patent No.: US 7,147,547 B2
(45) Date of Patent: Dec. 12, 2006

(54) METHOD AND DEVICE FOR GRINDING A ROTATIONALLY SYMMETRIC MACHINE PART

(75) Inventor: Erwin Junker, Buehl/Baden (DE)

(73) Assignee: Erwin Junker Maschinenfabrik GmbH, Nordrach (DE)

( * ) Notice: Subject to any disclaimer, the term of this patent is extended or adjusted under 35 U.S.C. 154(b) by 0 days.

(21) Appl. No.: 10/523,269

(22) PCT Filed: Jul. 29, 2003

(86) PCT No.: PCT/EP03/08374

§ 371 (c)(1),
(2), (4) Date: Jan. 31, 2005

(87) PCT Pub. No.: WO2004/012903

PCT Pub. Date: Feb. 12, 2004

(65) Prior Publication Data

US 2005/0255793 A1 Nov. 17, 2005

(30) Foreign Application Priority Data

Jul. 30, 2002 (DE) ..... 102 34 707

(51) Int. Cl.

| | |
|---|---|
| ***B24B 1/00*** | (2006.01) |
| ***B24B 7/19*** | (2006.01) |
| ***B24B 7/30*** | (2006.01) |
| ***B24B 5/00*** | (2006.01) |
| ***B24B 5/18*** | (2006.01) |
| ***B24B 7/00*** | (2006.01) |
| ***B24B 9/00*** | (2006.01) |

(52) U.S. Cl. ..... 451/57; 451/49; 451/58; 451/62; 451/132; 451/140; 451/195

(58) Field of Classification Search ..... 451/57, 451/58, 62, 132, 140, 195, 49
See application file for complete search history.

(56) References Cited

U.S. PATENT DOCUMENTS

| | | | | |
|---|---|---|---|---|
| 5,274,961 | A * | 1/1994 | Himmelsbach et al. | 451/547 |
| 5,681,208 | A * | 10/1997 | Junker | 451/49 |
| 5,899,797 | A * | 5/1999 | Junker | 451/62 |
| 6,685,536 | B1 * | 2/2004 | Junker | 451/5 |

FOREIGN PATENT DOCUMENTS

| | | |
|---|---|---|
| DE | 4326595 | 2/1995 |
| DE | 19800034 | 7/1999 |
| DE | 19921785 | 11/2000 |
| WO | WO 0009290 | 2/2000 |

OTHER PUBLICATIONS

PCT Publication WO00/67947, Junker, Method for Grinding Convex Running Faces and Outside Diameters on Shaft-Like Workpieces in One et-Up and Grinding Machine for Carrying Out the Method, Nov. 16, 2000.*

* cited by examiner

*Primary Examiner*—Joseph J. Hail, III
*Assistant Examiner*—Bryan Muller
(74) *Attorney, Agent, or Firm*—Jordan and Hamburg LLP

(57) ABSTRACT

A method and a device for grinding a machine part that has two shaft elements, a machine part axis and a large diameter central element having a side surface which is embodied in the form of a flat truncated cone. The machine part is clamped between centers and is movable in a direction of the machine part axis. The side surface is ground by a cylindrical outer contour of a first grinding wheel such that the cutting speed is constant across the entire axial dimension of the first grinding wheel which is mounted on a grinding spindle along with a second, narrower grinding. The second grinding wheel is positioned to grind the shaft element by swiveling the spindle using two pivots that are located perpendicular to each other and by displacing the grinding spindle perpendicular to the machine part axis with the machine part remaining in the same clamped position.

15 Claims, 7 Drawing Sheets

METHOD AND DEVICE FOR GRINDING A ROTATIONALLY SYMMETRIC MACHINE PART

The invention relates to a method for grinding a rotationally-symmetrical machine part with two axle parts and a center part situated therebetween that has an enlarged diameter and on which is embodied an active surface, for example, in the shape of a flat truncated cone surface with a cross-section that has a contour that is a straight line or is curved.

Machine parts of this type are present, for instance, in transmissions with continuously variable gears, as are needed in motor vehicles. Two machine parts oppose one another with active surfaces facing one another. The active surfaces thus form an annular space with a nearly wedge-shaped cross-section in which a tension member, such as for instance a chain or a belt, moves in and out between different radii depending on the distance from the active surfaces. Since such a transmission must work very precisely and transmit large torques, high demands are placed on the dimensional stability and surface quality of the machine parts. This also applies to the associated grinding procedures, in particular when grinding the active surface.

Until now, in practice the method cited in the foregoing has been performed in several operations, that is, in a plurality of chuckings. The active surface is ground by means of corundum grinding wheels using the angular infeed grinding method. In accordance with the same method, cylindrical exterior surfaces of an associated axle parts are ground, which as a rule are graduated.

This method has a number of disadvantages. First, it requires grinding wheels with a conical shape, which are difficult to manufacture and dress. In such grinding wheels with circumferential regions of very different diameters, the circumferential speeds of the regions to be ground are also different. This means that the critical cutting speed at the grinding location must be different and therefore cannot be optimal over all. The result of this is regions of varying roughness, which has a very negative effect, particularly for the active surface present on the conical shaped center part. Finally, there are also problems involving cooling by means of the conventional emulsions and grinding oils. That is, during angular infeed grinding a narrowing wedge occurs at the grinding location, and coolant/lubricant cannot be fed to it optimally. The result is thus uneven cooling of the grinding location. All of these difficulties can be traced back to the fact that the aforesaid known method has in the past been performed with corundum grinding wheels, which have a significantly shorter service life and must be dressed more frequently than CBN grinding wheels, which have since come into wider use.

Known from DE 43 26 595 C2 is a universal grinding station for tool grinding that enables a plurality of combinations for mutual positioning of grinding heads and tool carriers. Furthermore known is a grinding head with two different grinding wheels (DE 37 24 698 A1) with which the various grinding operations can be undertaken in one workpiece chucking. It has also been suggested (DE 199 21 785 AI) to grind relevant machine parts in one chucking, whereby two separate grinding spindles are used.

SUMMARY

With the invention, the processing time is to be shortened while an improved grinding result is obtained compared to the known prior art. This occurs in a method with the features of the present invention.

Thus, in the inventive method the machine part to be ground remains in a single chucking in which all of the grinding procedures are undertaken. This is made possible in that the grinding spindle is pivoted about two pivot axes that are perpendicular to one another and in addition is displaced to the machine part parallel to its longitudinal axis and perpendicular thereto (X-axis). The grinding spindle thus can be brought into any desired position relative to the machine part, so that it becomes possible to grind both the active surface and additional cylindrical exterior surfaces situated on the machine part with grinding wheels that have a fundamentally cylindrical contour.

With an active surface that has a cross-section with a straight-line contour, the first grinding wheel with a basic cylindrical shape will also have a cross-section with a straight-line exterior contour. If the active surface is curved, the grinding wheel with a basic cylindrical form must also have a cross-section with a slightly curved conforming contour. The curves occurring in practice are very slight.

The grinding spindle and the machine part are relatively displaced in a direction parallel to the machine part longitudinal axis making it possible to grind the active surface with the cylindrical circumferential surface of the grinding wheel using the vertical grinding method, whereby the cited relative displacement effects positioning. Since, in the machine components of the type being discussed herein, the active surface has the shape only of a flat truncated cone surface, it is adequate when grinding the active surface to undertake the positioning movement in that the grinding spindle and the machine part are displaced relative to each other parallel to the longitudinal axis of the machine part along a Z-axis and also in a direction perpendicular to the longitudinal axis along an X-axis. From this movement, an angled component falls on the grinding location on the active surface, but it deviates only slightly from the direction of the longitudinal axis so that there is almost vertical grinding in the conventional sense.

A uniform cutting speed across the entire width of the grinding wheel results as an advantage. This ensures improved surface quality and surface structure. In addition, optimized dressing parameters are obtained when dressing the grinding wheel because when dressing the same parameters, identical dressing speed is attained as when grinding, as are the same revolutions per minute and advance values. Because the cutting speed of the grinding wheel remains the same across the active surface, the attainable surface roughness also remains the same. Optimum values for cutting volume per unit of time can also be attained using the same cutting speed of the grinding wheel across the entire "cone surface".

This is not the case for angular infeed grinding. Given an exterior diameter of the conical wheel, if one assumes a diameter of for instance 190 mm and an adjacent diameter on the cone surface of 40 mm, the workpiece speed changes by a factor of 4.75 because of the rotation of the workpiece during grinding. The height of the conical surface is thus approx. 75 mm.

Given an assumed diameter of the corundum grinding wheel of 750 mm, the cutting speed at the exterior diameter of the conical surface is then approx. 80% of the cutting speed of the grinding wheel at the smallest diameter of the conical surface. This opposes the cutting volume, because it is highest at the greatest diameter on the conical surface. This means that because of the grinding wheel placed perpendicular to the conical surface, the ratio of cutting speed to cutting volume that has to be carried across the conical surface is substantially improved.

Furthermore, significantly improved conditions when cooling the grinding zone result because practically these same conditions occur when grinding the active surface as during vertical grinding, so that there is a uniformly narrow cooling zone to which it is easy to feed the coolant/lubricant and which it also exits rapidly as well.

As already stated, when positioning, an angled component acts on the grinding location between the grinding wheel and the active surface because of the angle of the spindle relative to movement along the Z-axis. However, since the active surface is only slightly angled relative to the radial plane, the greatest portion of the positioning force is applied perpendicular to the active surface. A smaller force component results in the radial direction of the active surface so that work can be performed with optimized feed while grinding the running surface. This also reduces grinding time, and improved precision in the grinding of the active surface still results. Comparable advantages apply for the other cylindrical exterior surfaces situated on the machine part.

The grinding method can therefore be best performed with ceramic-bound CBN grinding wheels. Overall there is clearly a reduced number of cycles on modern processing machines with simultaneously substantially improved grinding results.

In the method of the invention, the active surface of the machine part is ground using a first grinding wheel that is disposed on the grinding spindle and that is cylindrical in shape and has a straight-line or conforming curved circumferential contour wherein the radial direction of the first grinding wheel is positioned perpendicular to the active surface, whereby the axial extension of the grinding wheel covers the radial angular extension of the active surface and the positioning occurs in that the grinding wheel and the machine part are moved relative to one another in the direction of the longitudinal axis of the machine part.

Here the first grinding wheel has a greater axial extension so that the entire active surface can be finish-ground in one vertical grinding procedure. If the active surface of the machine part is a truncated cone surface with a cross-section that has a straight-line contour, the first grinding wheel can have a cylindrical shape. When the cross-section of the active surface has a curved contour, a conforming curved circumferential contour of the first grinding wheel is also necessary. Thus across the axial extension of the first grinding wheel there are indeed differences in the cutting speed, which differences remain small; because the active surfaces of the machine parts to be ground here are only slightly concavely or convexly curved. However, the difference in the cutting speed, which is still available and present in the axial direction of the first grinding wheel, is still much smaller than during angular infeed grinding using the prior art.

For grinding the cylindrical exterior surfaces also situated on the machine part, a second grinding wheel is used with which the aforesaid cylindrical exterior surfaces can be ground using longitudinal grinding; all of the advantages of the movable grinding wheel are retained in that the second grinding wheel is disposed uniaxially with the first grinding wheel on the grinding spindle and the second grinding wheel preferably has a substantially narrower width than the first grinding wheel so that there is no problem undertaking longitudinal grinding of cylindrical exterior contours.

Advantageously, longitudinal grinding of the cylindrical exterior surfaces situated on the machine part occurs using rough-grinding, with which grinding to the final dimensions can be performed in one pass in a known manner. Since all requirements for a high quality grinding process have been met due to the chucking remaining the same, rough-grinding can be performed here, which further reduces the number of cycles with high grinding quality.

The cylindrical exterior surfaces to be ground can also be processed using plunge-cut grinding if necessary.

In all of the aforesaid variations of the inventive grinding method, the machine component is advantageously chucked between centers and driven to rotate by at least one of the centers. Precise centering is least disturbed when there is internal drive by one of the centers, despite the rotating drive. This also results in a high quality grinding result.

The ability of the grinding spindle to pivot about two axes that are perpendicular to one another, which is required in the method, is accomplished in that when the machine part is held horizontal the grinding spindle is pivoted about a vertically running first pivot axis and about a second pivot axis that runs horizontally. This design of the method permits known embodiments of grinding machines to be used, which means that practical performance of the inventive method remains feasible economically, as well.

The invention also relates to an apparatus for grinding a rotationally-symmetrical machine part of the type cited in the foregoing in connection with the method of the aforesaid known type. In an apparatus for grinding a rotationally-symmetrical machine part with two axle parts and a center part situated therebetween that has an enlarged diameter and against which is embodied an active surface in the shape in particular of a flat truncated cone surface with a straight or curved contour in the cross-section, in particular for performing the method the apparatus of the invention comprises:

tension and drive members for chucking the machine part at its end faces and for rotationally driving it, a grinding spindle slide that can be moved in a direction running transverse to the longitudinal axis of the machine part, a device for mutual longitudinal displacement of the machine part and the grinding spindle slide in a direction parallel to the longitudinal axis of the machine part, a grinding spindle that is arranged at the grinding spindle slide via two pivot axes that run perpendicular to one another, and two grinding wheels that are borne uniaxially on the grinding spindle and are driven to rotate thereby, of which the first grinding wheel intended for grinding the active surface situated on the machine part has a width that corresponds at least to the radial angular extension of the active surface, while the second grinding wheel intended for grinding cylindrical circumferential surfaces has a narrower width, and in which the grinding wheels (15,16) are mounted overhung on one and the same side of the grinding spindle (14).

Given the foregoing description of the method and apparatus, particular explanations of the apparatus cited in the foregoing are not required. The apparatus includes an overhung mounting of both grinding wheels on one and the same side of the grinding spindle. This results in a structurally simple design of the grinding wheel, whereby simply graduating the diameter of the two grinding wheels alone makes it possible for the two grinding wheels to not disturb one another during the various processing procedures.

Furthermore, it is advantageous when the tension and drive members for chucking the machine part are formed by sleeves that are attached to a workpiece headstock and tailstock and that centeringly engage with centers disposed on them end-face bores of the machine part, and when at least the center disposed on the workpiece headstock is provided with a coupling that is mechanically linked to the end-face bore of the machine part via tension members that act radially from outside for the purpose of rotationally carrying the machine part.

The rotary drive of the machine part from the interior of a center that centers this machine part means that the rotary drive does not disturb the centering. The tension members acting from inside to outside do not apply any axial forces to the machine part or the centers. Thus there are no tensions or bending of the machine part despite reliable rotary carrying. Thus reliable rotary drive is linked to centering with highly uniform precision.

Structurally, such a coupling can be realized in that it is embodied as a split cone coupling, the outwardly spreading tension members of which are embodied as chucking jaws and are arranged in the region of the tip of a longitudinal bore of the shaft situated on the workpiece headstock, and in that the tension members are actuated by a connecting rod that passes through the longitudinal bore and is provided with an actuating cone in the region of the chucking jaws.

Thus, it is primarily chucking jaws that can be displaced under the influence of an actuating cone that are used for chucking members. However, it is also possible to use the actuating cone to influence spheres acting as tension members. Refer to patent holder's EP 0 714 338 B1 for additional details on such a split cone coupling acting on the interior of a centering tip. The further development cited here can be supplemented in that such a split cone coupling can be arranged in the tip of the tailstock center, as well.

The great mobility of the single grinding spindle realized in the apparatus also ensures that adequate space must be available between the workpiece headstock and the tailstock. In addition, machine parts of the type to be ground in this case are frequently equipped with bilateral axis parts of substantial length. When there are particularly high demands on the grinding results it is therefore advantageous when, in accordance with another embodiment of the inventive apparatus, the center disposed on the workpiece headstock and/or tailstock is supported a shaft of the center by one or a plurality of rests. Flexion of the centers, and thus also of the machine part, is thus largely prevented without rests disposed directly on the machine part being noticeable in a disturbing manner.

The required mutual longitudinal displacement of the machine component and the grinding spindle slide can be realized advantageously in that the tension and drive members for clamping and for rotationally driving the machine part are disposed on a grinding table that can be moved in the longitudinal direction of the machine part relative to the grinding spindle slide.

However, it is also possible, with nothing further to securely attach the tension and drive members directly to the machine bed and, to provide the grinding spindle slide additional mobility parallel to the longitudinal direction of the machine part.

For the design of the first and second pivot axis of the grinding spindle it is provided that arranged on the grinding spindle slide via a first pivot axis that runs perpendicular to a displacement of the grinding spindle slide, is a grinding headstock on which the grinding spindle is pivotably disposed via a second pivot axis that runs perpendicular to the first pivot axis.

Using such an arrangement, the grinding spindle can be brought into the various processing positions on the machine part in a particularly advantageous manner, whereby the two grinding wheels do not disturb one another.

The apparatus is optionally equipped with ceramic-bound CBN grinding wheels because these have a particularly long service life and lead to particularly good grinding results in the apparatus. This applies in particular to the first grinding wheel for grinding the active surface.

BRIEF DESCRIPTION OF THE DRAWINGS

The invention will now be explained in even greater detail using the exemplary embodiments that are illustrated in the figures. The figures illustrate the following.

Figure 1:
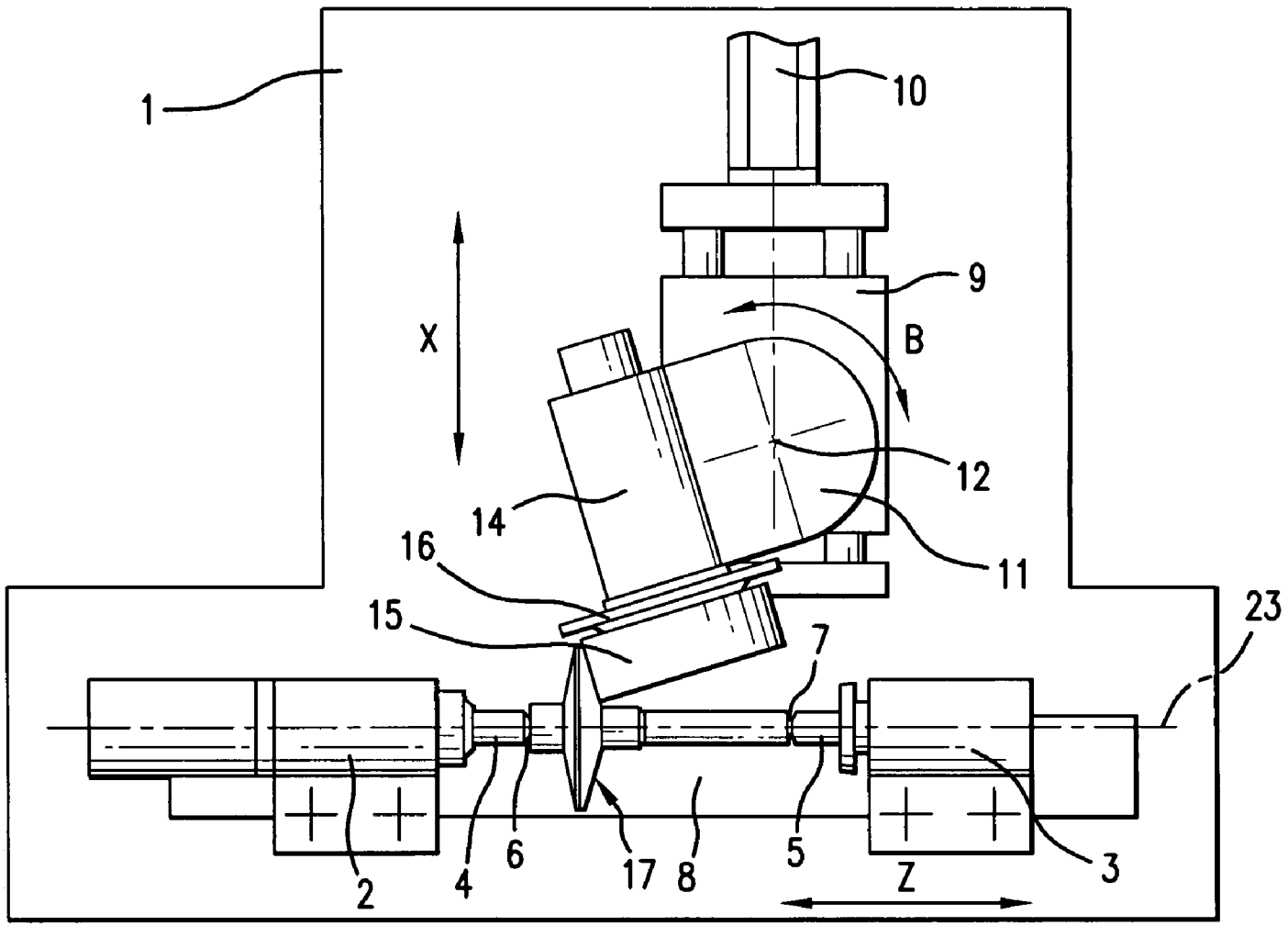
FIG. 1 illustrates a view from above onto an of the invention apparatus in a first processing phase.
Figure 2:
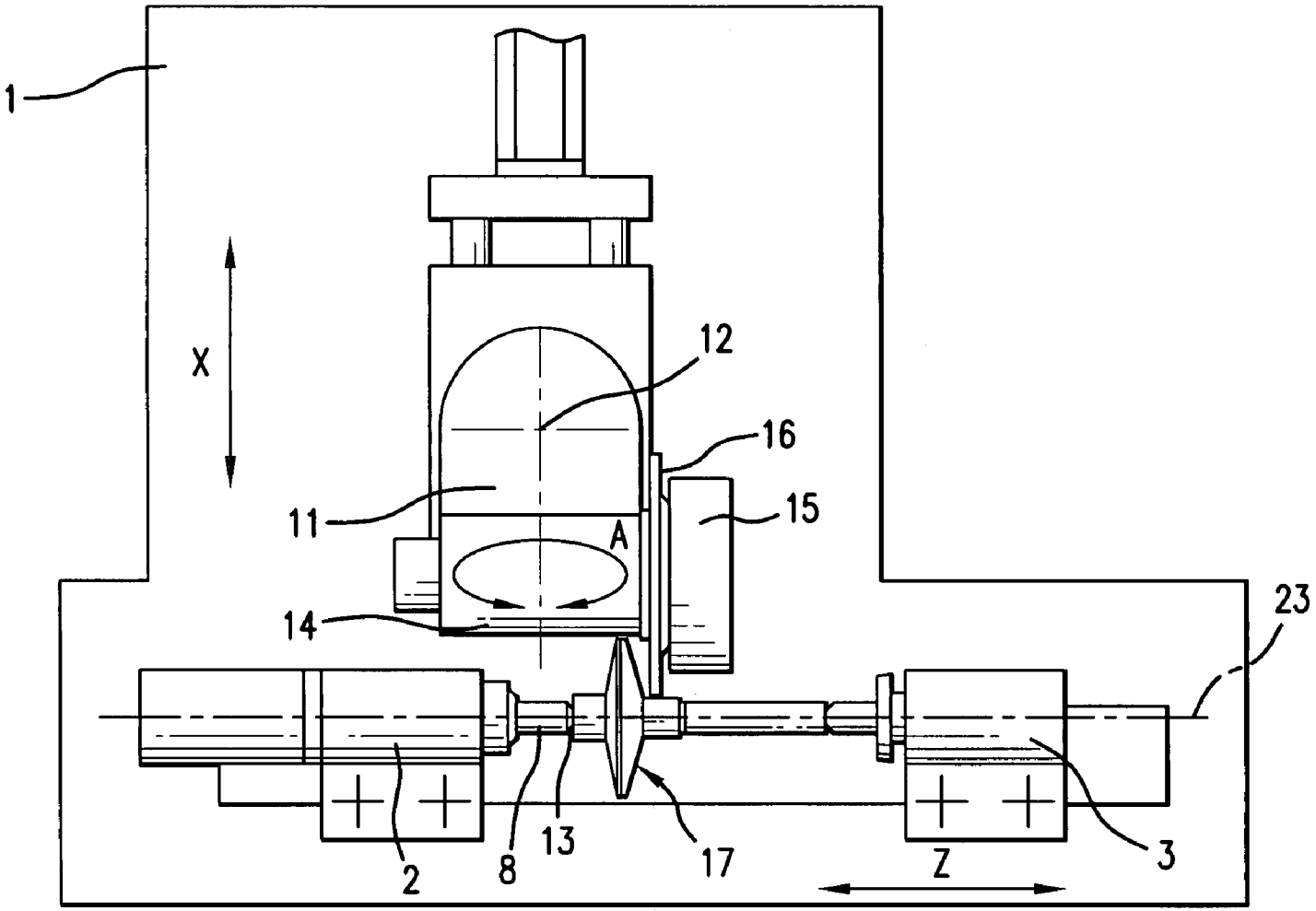
FIG. 2 depicts a view corresponding to FIG. 1 in a subsequent processing phase.
Figure 3:
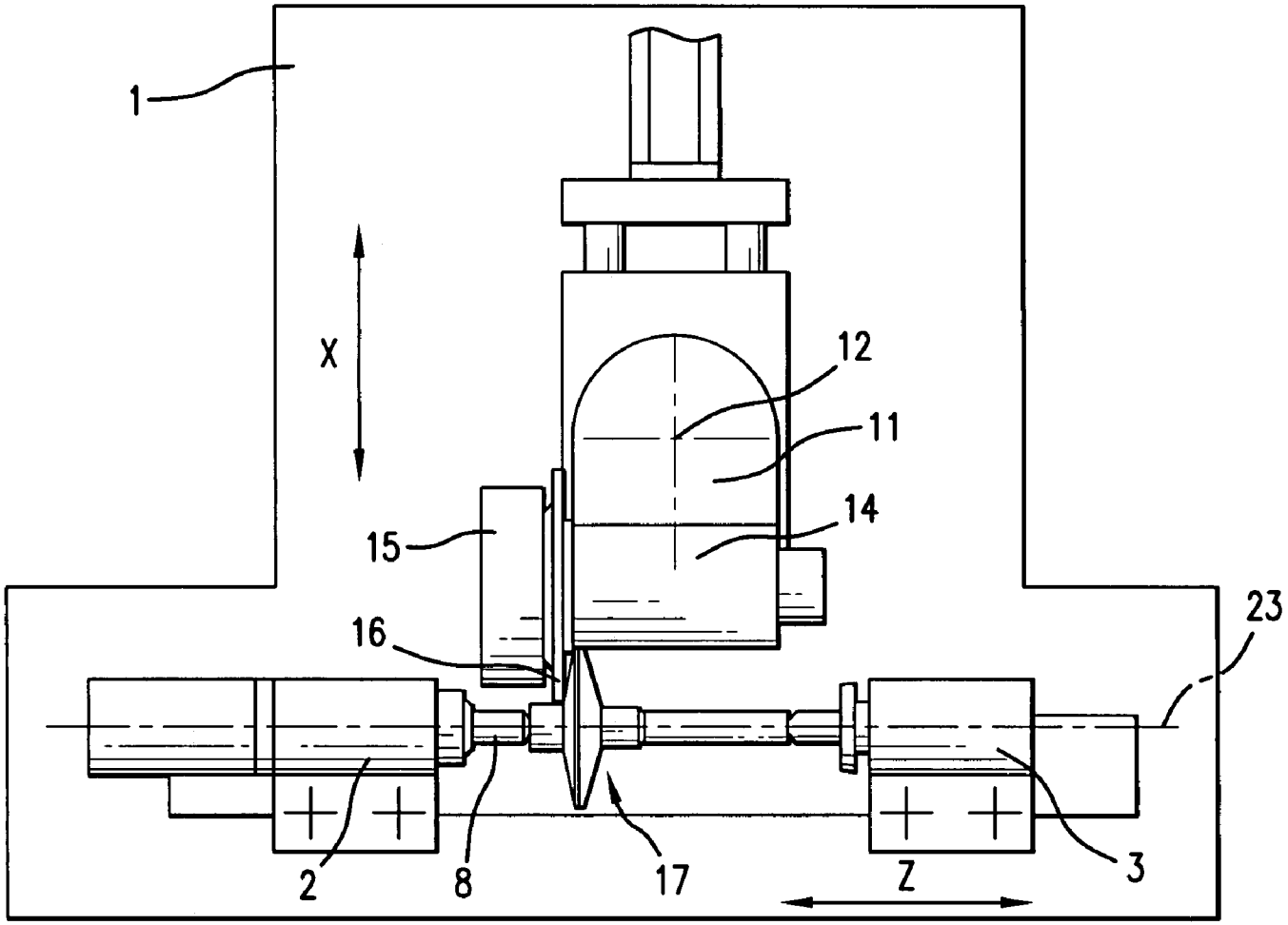
Figure 4:
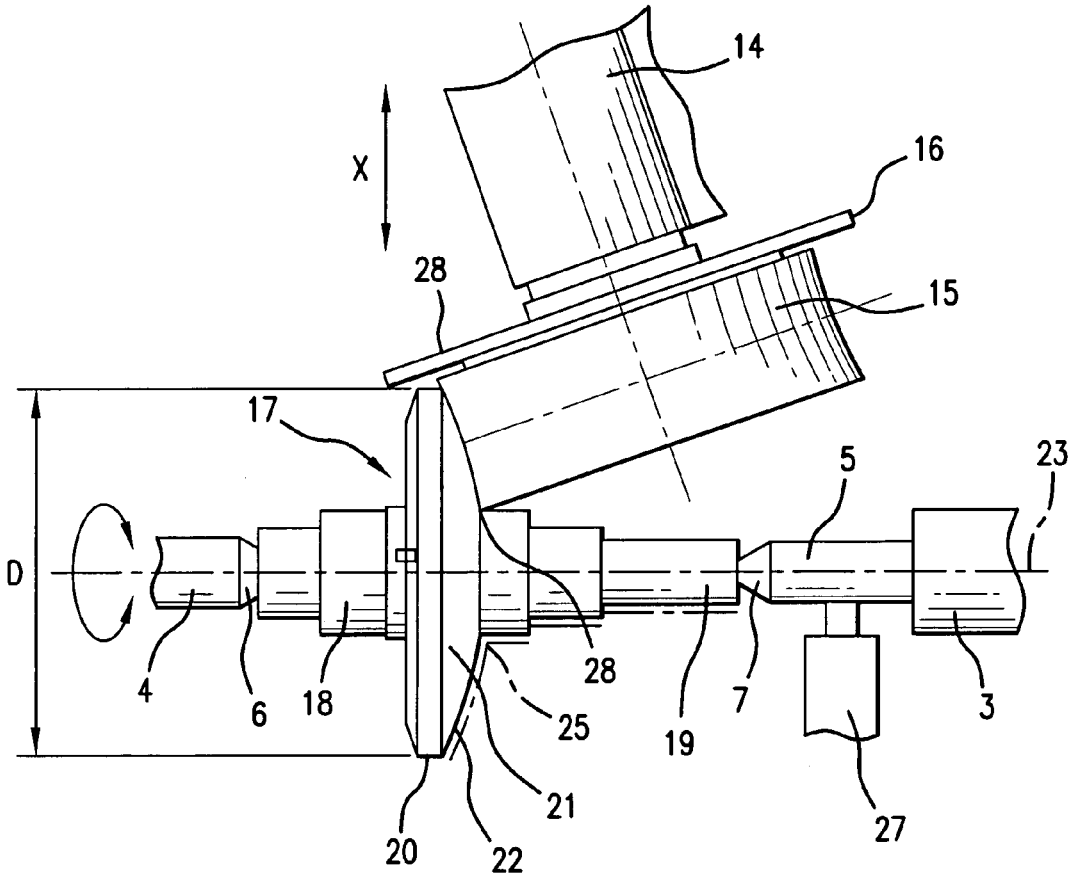
Figure 5:
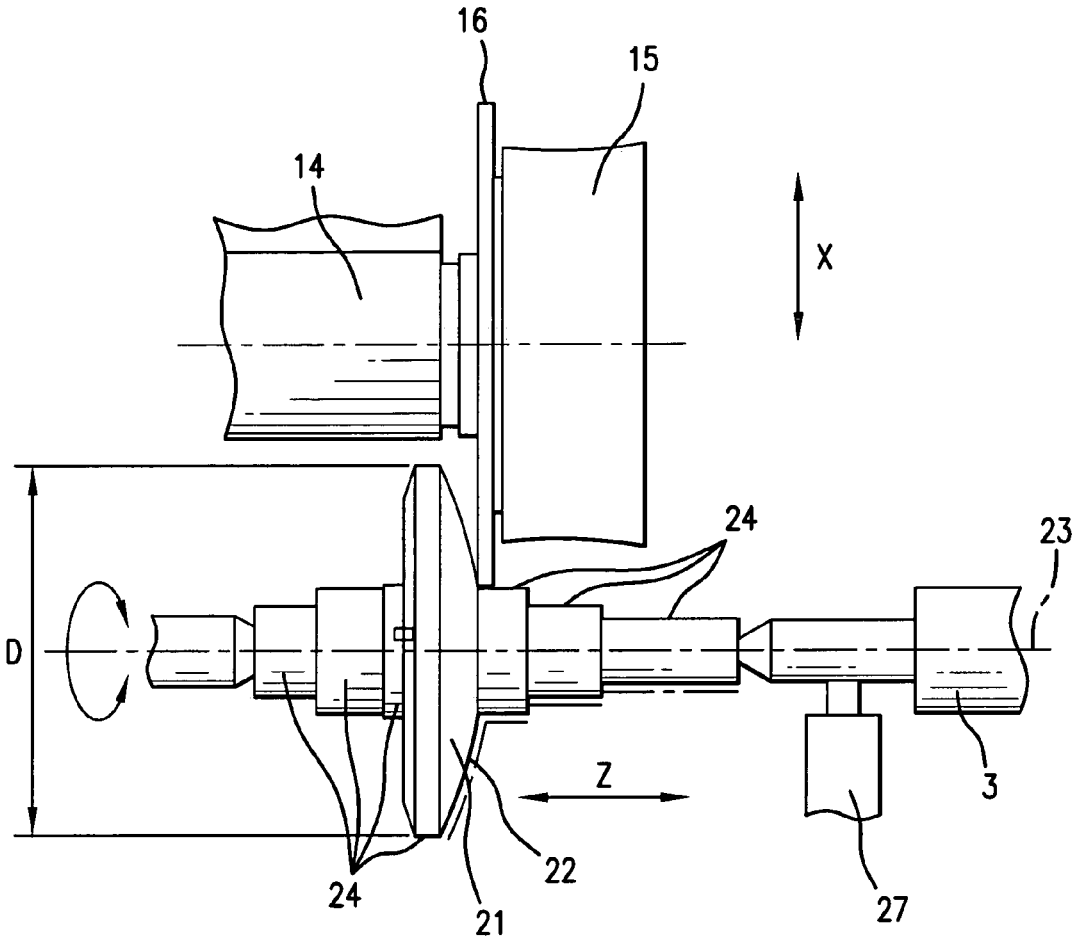
Figure 6:
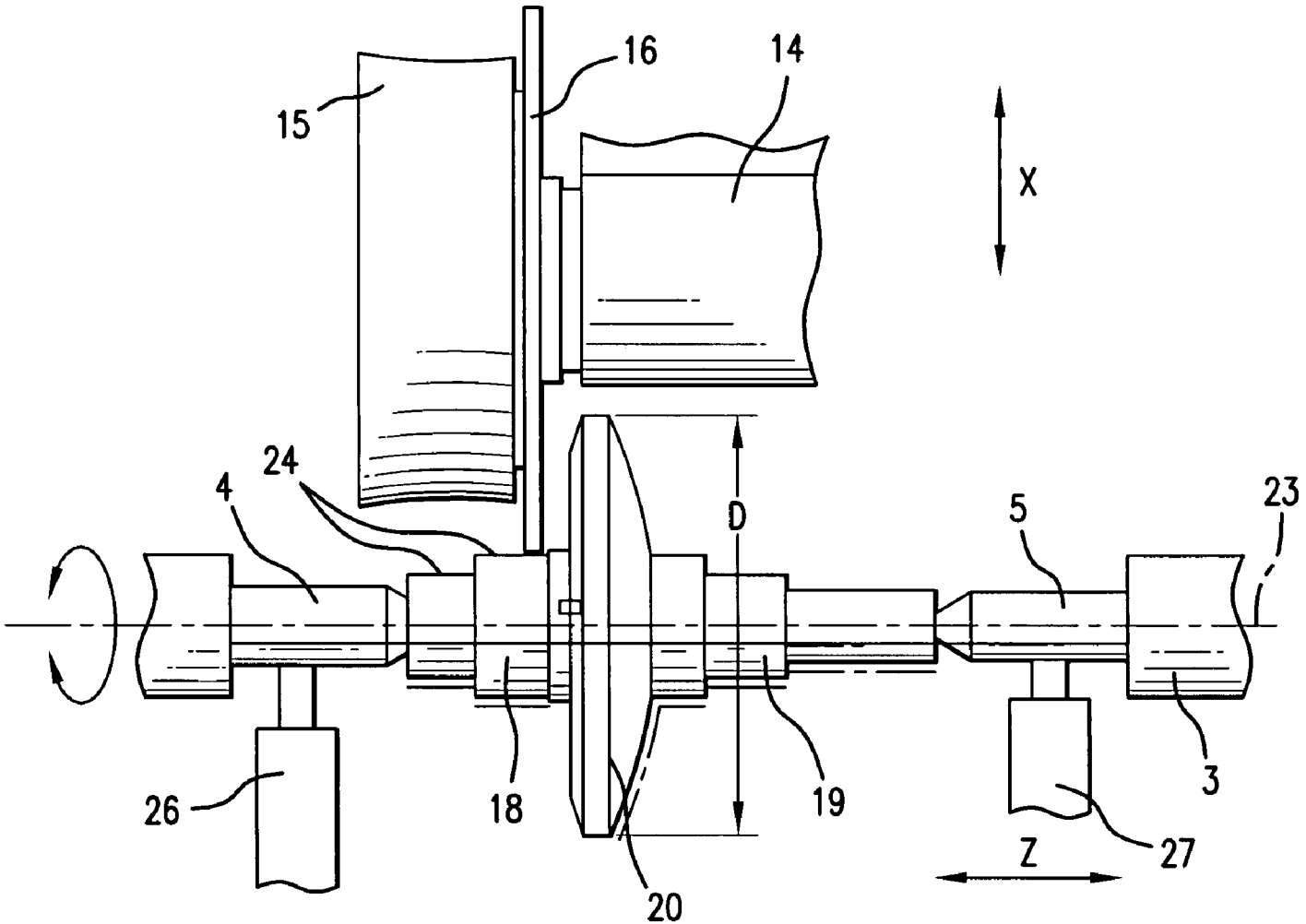

The subject of FIG. 3 is third processing phase in an otherwise identical representation;

FIG. 4 is an enlarged depiction of details in FIG. 1;

FIG. 5 is also an enlarged depiction of details of the cooperation of the machine part and the grinding wheel corresponding to the processing phase illustrated in FIG. 2;

FIG. 6 is an enlarged depiction of details in FIG. 3; and

Figure 7:
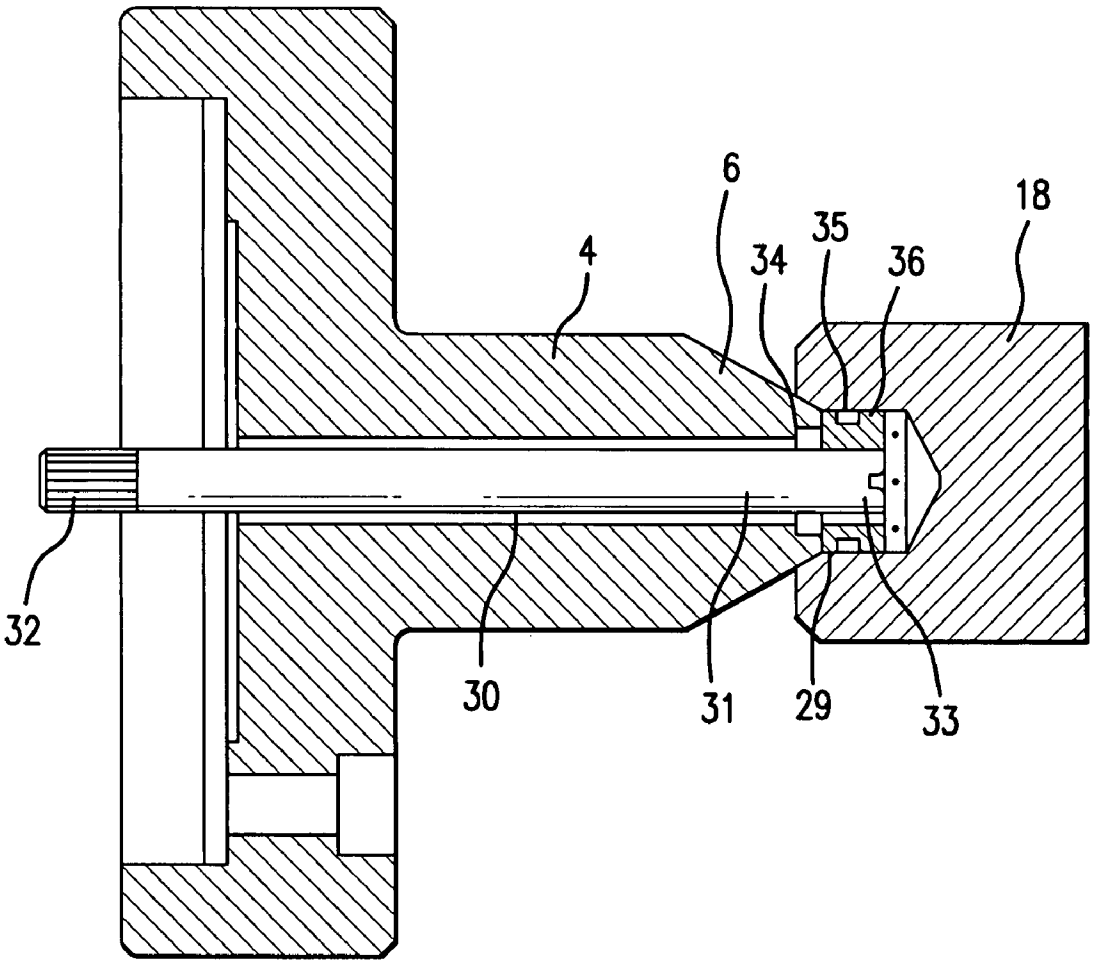

FIG. 7 illustrates a detail for chucking, centering, and driving of the machine part to be ground.

DETAIL DESCRIPTION

FIG. 1 illustrates an inventive apparatus for grinding with which in particular the inventive method is to be performed. The apparatus in accordance with FIG. 1 comprises a machine bed 1 attached to which are a workpiece headstock 2 and a tailstock 3. Workpiece headstock 2 and tailstock 3 have the conventional sleeves (not shown) with the centers 6 and 7 disposed on the shafts 4, 5 between which centers the machine part 17 to be ground is chucked. In the illustrated exemplary embodiment, the workpiece headstock 2 and the tailstock 3 are arranged on a grinding table 8 that can be moved in the longitudinal direction of the machine part 17. Once chucked, the machine part 17, the workpiece headstock 2 and the tailstock 3 have a common longitudinal axis 23 that can be considered a reference line for arranging the other parts.

FIG. 1 furthermore schematically illustrates a grinding spindle slide 9 that can be moved by means of a displacement motor 10 in a direction perpendicular to the longitudinal axis 23. Attached to the grinding spindle slide 9 is a grinding headstock 11 that can be pivoted about a first pivot axis 12. The first pivot axis 12 is perpendicular to the displacement plane of the grinding spindle slide 9 and is thus normally oriented vertically.

Attached to the grinding headstock 11 is a grinding spindle 14; it is pivotably joined to the grinding headstock 11 via a second pivot axis 13. The position of the second pivot axis 13 can be seen in FIG. 2. The second pivot axis 13 runs perpendicular to the first pivot axis 12 and intersects the common longitudinal axis 23 of the workpiece headstock 2, machine part 17, and tailstock 3 in the conventionally occurring positions.

The rotating option for the grinding headstock 11 resulting from the first pivot axis 12 is labeled with the curved double arrow B in FIG. 1. The pivot option for the grinding spindle 14 relative to the grinding headstock 11, resulting from the second pivot axis 13, is indicated in FIG. 2 with the curved double arrow A, which must be seen as a three-dimensional illustration.

Two grinding wheels 15 and 16 are borne closely overhanging one another on the one side of the grinding spindle 14.

The enlarged depictions in FIGS. 4 through 6 make it particularly easy to see the uniqueness of the machine part to be ground and the sequence of the individual processing phases.

The machine part 17 to be ground comprises a first axle part 18, a second axle part 19, and a center part 20 located therebetween, the exterior diameter D of which is clearly greater than that of the axle parts on either side thereof. Essential for the center part 20 is a region in the basic shape of a truncated cone 21. In cross-section, the truncated cone can have a contour that is a straight line, but it can also have a curved convex or concave contour. Such machine parts in automatic transmissions for instance form an active surface 22 along which a chain or belt with varying radii can move. Two such active surfaces are placed against one another, and the chain or the belt is situated therebetween.

However, the machine part also has cylindrical exterior surfaces 24 that must also be ground; all of the surfaces are shown in FIG. 5. The line 28 in FIG. 4 indicates the line of action or contact between the first grinding wheel 15 and the active surface 22; the cutting speed of the grinding wheel, that is, its speed on the exterior circumference, is very important in this line of contact 28.

Furthermore shown in FIGS. 4 through 6 are rests 26 and 27 that can support the centers 6 and 7 of the workpiece headstock and tailstock. In the method to be performed inventively, an increased need for space occurs between the workpiece headstock 2 and the tailstock 3 due to the intermittent angled positioning of the grinding spindle 14 (see FIG. 4). The shafts 4 and 5 of the centers 6 and 7 must thus be embodied relatively long; when there are particularly high demands on grinding precision they are therefore supported by the rests 26 and 27 so that they do not flex under the effect of the grinding wheels.

FIG. 7 illustrates one option for how the machine part to be ground can be chucked and precisely centered on the centers 6, 7 and yet still be effectively driven to rotate.

For this reason the center 6 is extended in a cylindrical projection 29 of small diameter. Passing through the center 6 and its shaft 4 for its entire length is a longitudinal bore 30, through which a connecting rod 31 is conducted. At its end this has a threaded segment 32 that moves the connecting rod back and forth using appropriate actuating mechanisms. Embodied on the connecting rod 31 at its opposing end is an actuating cone 33 that cooperates with tension members disposed thereupon. The tension members are formed by chucking jaws 36. For this, a first tension ring 34 and a second tension ring 35 are present that can comprise for instance slit metal rings or rings made of a rubber-like substance. The tension rings 34 and 35 hold the chucking jaws 36 in place in the center 6 and prevent horizontal displacement of the chucking jaws; the chucking jaws are only displaceable in one direction perpendicular to the connecting rod. The axial force component that occurs from the first tension ring 34 is minor and can be ignored. The aforesaid parts form within the cylindrical projection 29 a split cone coupling. For instance, three chucking jaws 36 can be present at intervals of 120 degrees each. Now if the connecting rod 31 in FIG. 7 is pulled to the left, the actuating cone 33 presses the chucking jaws 36 outward, which axially compresses the first tension ring 34 and presses the second tension ring 35 outward. Since the cylindrical projection 29 projects into the end-face bore 37 of the first axis part, which is disposed on the machine part 17, as a result the center 6 and the axle part 18 are securely fastened to one another, which ensures secure rotational carrying without having a negative effect on the precision of the centering.

The split cone coupling shown in FIG. 7 can be structurally modified. For instance, it is possible to use one or a plurality of spheres instead of the chucking jaws and the second tension ring 35. Details in this regard can be found in Applicant's EP 0 714 338 31.

The following describes the sequence of events in the grinding method as it occurs on an apparatus in accordance with FIGS. 1 through 7.

Bores 37 must be added to the end faces on the machine part 17, that is, to the two axle parts 18 and 19, whereby the machine part 17 can be chucked and driven between the centers 6, 7 of workpiece headstock 2 and tailstock 3. The machine part 17 is then caused to rotate, while being precisely centered, by actuating the split cone coupling seen in FIG. 7.

In the first processing phase, in which the active surface 22 is ground, the grinding spindle 14, by pivoting about the first pivot axis 12, is located in the position seen in FIGS. 1 and 4. Corresponding to the angle of taper of the active surface 22, the grinding spindle 14 is also positioned on a slight angle so that the circumference of the first grinding wheel 15 is positioned largely perpendicular to the active surface 22 to be ground.

When the cross-section of the active surface 22 has a contour that is a straight line, the exterior contour of the first grinding wheel 15 will also be a straight line. However, if the active surface 22 is a concave or convex curve, the first grinding wheel 15 must have a conforming opposing curve. In practice, the curves on the active surfaces of such machine parts are relatively slight. Thus, during the perpendicular grinding of the active surface there is the advantage in every case that the cutting speed of the grinding wheel is largely the same across the entire axial extension of the grinding wheel 15. This is a decided advantage over conventional angular infeed grinding used in the past. Since the axial extension of the first grinding wheel 15 completely covers the radial angular extension of the active surface 22, in a single vertical grinding procedure the grinding overage 25 can be taken off and the desired high-quality grinding condition of the active surface 22 can be attained. The positioning movement occurs in that the grinding table 8 is moved in the direction of the longitudinal axis 23. A corresponding angular component strikes the line of contact 28 on the active surface 22. In principle, the grinding table could also remain fixed and the grinding spindle slide 9 could be moved.

When the active surface 22 has been processed completely, the grinding spindle slide 9 is moved a short distance outward from the machine part 17, and the grinding headstock 11 is rotated about the first pivot axis 12, which runs perpendicular to the displacement plane of the grinding spindle slide. The grinding spindle 14 is then moved into the position seen in FIGS. 2 and 5. In this position, all of the cylindrical exterior surfaces 24 that are situated on the center part 20 and the second axis part 19 can undergo longitudinal grinding by means of the second grinding wheel 16. Preferred in this second processing phase is rough-grinding, in which grinding is performed in one axial pass immediately to the final diameter. In this case, as well, longitudinal feed occurs by moving the grinding table 8. When the second processing phase has concluded, the grinding spindle 14 is pivoted about the second horizontally-running pivot axis 13-to an extent is turned "upside down"—so that the two grinding wheels 15 and 16 now assume the positions shown in FIGS. 3 and 6 relative to the machine part 17 to be ground.

As can be seen, in the third processing phase the remaining exterior surfaces 24 in the area of the first axis part are now longitudinally ground, and the second grinding wheel 16 is again used for this.

Grinding in a single chucking, in which the grinding spindle together with the two grinding wheels "moves around" the entire machine part to be ground, combines an excellent grinding result with much smaller number of cycles.

What is claimed is:

1. A method for grinding a rotationally-symmetrical workpiece having first and second cylindrical parts and a center part situated therebetween that has an outer diameter surface having a diameter greater than diameters of said first and second cylindrical parts and first and second center part side surfaces respectively disposed between said outer diameter surface and said first and second cylindrical parts:

providing a grinding spindle having first and second grinding wheels mounted uniaxially thereon at spindle end portion and rotatable about a spindle axis, said first grinding wheel having first and second sides with a first grinding wheel outer circumferential surface therebetween which is substantially cylindrical, said first grinding wheel outer circumferential surface having a profile conforming to and extending a length of said first center part side surface to be ground;

chucking said workpiece at ends of the first and second cylindrical parts to place said workpiece in a chucked state;

rotating said workpiece about a workpiece rotation axis in said chucked state;

supporting said grinding spindle on first and second pivots, said first pivot having a first pivot axis oriented perpendicular to said workpiece rotation axis, and said second pivot having a second pivot axis oriented in a direction perpendicular to said spindle axis and perpendicular to said first pivot axis;

pivoting said grinding spindle on said second pivot between a second pivot first position placing said first and second grinding wheels at a first side of said second pivot, and a second pivot second position placing said first and second grinding wheels at a second side of said second pivot opposite said first side of said second pivot;

pivoting said grinding spindle on said first pivot to align said grinding spindle axis parallel to a radial angular extension of a mean surface contour of said first center part side surface to orient said first grinding wheel outer circumferential surface for grinding said first center part side;

moving said first grinding wheel outer circumferential surface and said first center part side surface relative to one another along said workpiece axis direction with said first grinding wheel outer circumferential surface aligned along a workpiece rotation axis direction with said first center part side surface when said grinding spindle is pivoted to said second pivot first position to profile grind said first center part side surface;

pivoting said grinding spindle on said first pivot to align said grinding spindle axis parallel to said workpiece rotation axis to position said second grinding wheel to grind said first cylindrical part when said grinding spindle is in said second pivot first position;

grinding said first cylindrical part with said second grinding wheel by moving said first cylindrical part and said second grinding wheel relative to one another along said workpiece rotation axis direction;

pivoting said grinding spindle on said first pivot, with said grinding spindle in said second pivot second position, to align said grinding spindle axis parallel to said workpiece rotation axis to position said second grinding wheel to grind said second cylindrical part; and grinding said second cylindrical part with said second grinding wheel by moving said second cylindrical part and said second grinding wheel relative to one another along said workpiece rotation axis direction.

2. The method in accordance with claim 1, wherein a width of said second grinding wheel is less than that of said first grinding wheel.

3. The method in accordance with claim 2, wherein the grinding of the first and cylindrical parts comprises rough-grinding.

4. The method in accordance with claim 2, wherein the grinding of the first and cylindrical parts comprises plunge-cut grinding.

5. The method in accordance with claim 2, wherein the said workpiece is chucked between centers and driven to rotate by at least one of said centers.

6. The method in accordance with claim 2, wherein said workpiece is held horizontally and said first pivot axis is vertical and said second pivot axis is horizontal.

7. The method in accordance with claim 2, wherein said first center part side surface forms a truncated cone.

8. The method in accordance with claim 2, wherein said first center part side surface is one of concave and convex.

9. The method in accordance with claim 1, wherein the grinding of the first and cylindrical parts comprises rough-grinding.

10. The method in accordance with claim 1, wherein the grinding of the first and cylindrical parts comprises plunge-cut grinding.

11. The method in accordance with claim 1, wherein the said workpiece is chucked between centers and driven to rotate by at least one of said centers.

12. The method in accordance with claim 1, wherein said workpiece is held horizontally and said first pivot axis is vertical and said second pivot axis is horizontal.

13. The method in accordance with claim 1, wherein said first center part side surface forms a truncated cone.

14. The method in accordance with claim 1, wherein said first center part side surface is one of concave and convex.

15. The method in accordance with claim 1, wherein said first center part side surface is profile ground before said first cylindrical part is ground and said first cylindrical part is ground before said second cylindrical part is ground.

* * * * *